US012359830B2

(12) United States Patent
Aschow et al.

(10) Patent No.: US 12,359,830 B2
(45) Date of Patent: Jul. 15, 2025

(54) SYSTEMS AND METHODS FOR PREDICTING REFRIGERANT LEAKAGE OF A CRITICALLY CHARGED HVAC/REFRIGERATION SYSTEM

(71) Applicant: Google LLC, Mountain View, CA (US)

(72) Inventors: Evan Aschow, Fair Oaks, CA (US); Michael May, Reno, NV (US); Joel Cesare, Santa Cruz, CA (US); Tony Cacace, Santa Cruz, CA (US); John Sipple, Reston, VA (US); Kira Dickson, San Francisco, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 17/952,909

(22) Filed: Sep. 26, 2022

(65) Prior Publication Data

US 2024/0102677 A1 Mar. 28, 2024

(51) Int. Cl.

| | |
|---|---|
| ***F24F 11/38*** | (2018.01) |
| ***F24F 11/36*** | (2018.01) |
| ***F24F 11/63*** | (2018.01) |
| ***F25B 45/00*** | (2006.01) |

(52) U.S. Cl.

CPC ..... *F24F 11/38* (2018.01); *F24F 11/36* (2018.01); *F24F 11/63* (2018.01); *F25B 45/00* (2013.01); *F25B 2345/001* (2013.01)

(58) Field of Classification Search

CPC .. F24F 11/38; F24F 11/36; F24F 11/63; F24F 11/58; F25B 2500/22; F25B 2500/221; F25B 2500/222

See application file for complete search history.

(56) References Cited

U.S. PATENT DOCUMENTS

| | | | | |
|---|---|---|---|---|
| 9,285,802 | B2 | 3/2016 | Arensmeier | |
| 9,703,287 | B2 | 7/2017 | Arensmeier | |
| 9,995,502 | B1 | 6/2018 | Reeder | |
| 10,234,854 | B2 | 3/2019 | Arensmeier | |
| 10,309,677 | B2 | 6/2019 | Abiprojo et al. | |
| 10,584,890 | B2 * | 3/2020 | Steinberg | G05D 23/1905 |
| 10,655,874 | B1 | 5/2020 | Reeder | |
| 10,884,403 | B2 | 1/2021 | Arensmeier | |
| 10,948,209 | B2 | 3/2021 | Song et al. | |
| 2017/0314800 | A1 | 11/2017 | Bengea et al. | |
| 2018/0051900 | A1 * | 2/2018 | Van Goor | G05B 15/02 |

(Continued)

*Primary Examiner* — Nelson J Nieves

(74) *Attorney, Agent, or Firm* — DORITY & MANNING P.A.

(57) ABSTRACT

A system for predicting a leak of a HVAC/Refrigeration system includes a critically charged HVAC/Refrigeration system configured to circulate a refrigerant to cool a space, and processing circuitry. The processing circuitry is configured to obtain the subcooling data from the critically charged HVAC/Refrigeration system. The processing circuitry is configured to predict a leak event by providing the subcooling data as an input to a neural network. The neural network is trained using historical data of one or more subcooling parameters of a plurality of critically charged HVAC/Refrigeration systems. The processing circuitry is configured to operate a display to provide a notification to a technician or a manager regarding the predicted leak event at the critically charged HVAC/Refrigeration system.

7 Claims, 10 Drawing Sheets

(56) References Cited

U.S. PATENT DOCUMENTS

| | | | | |
|---|---|---|---|---|
| 2018/0087795 | A1* | 3/2018 | Okita | H04L 12/2816 |
| 2018/0328612 | A1* | 11/2018 | Sinha | F24F 11/30 |
| 2019/0086106 | A1* | 3/2019 | Okita | F24F 11/62 |
| 2019/0086108 | A1* | 3/2019 | Okita | F24F 11/46 |
| 2019/0226705 | A1* | 7/2019 | Sakae | F25B 49/02 |
| 2021/0003308 | A1* | 1/2021 | Venne | F24F 11/63 |
| 2021/0071897 | A1* | 3/2021 | Casa | G05B 23/024 |
| 2021/0262689 | A1 | 8/2021 | Shinde et al. | |
| 2022/0010996 | A1* | 1/2022 | Carrieri | F24F 11/49 |
| 2022/0146136 | A1 | 5/2022 | Ba et al. | |
| 2022/0268479 | A1* | 8/2022 | Jang | G06N 3/088 |
| 2022/0268503 | A1* | 8/2022 | Yoshimi | F24F 11/64 |
| 2022/0377001 | A1* | 11/2022 | Nohara | H04L 43/0823 |
| 2023/0102333 | A1* | 3/2023 | Johnson | F24F 11/64 700/276 |
| 2023/0116964 | A1* | 4/2023 | Sun | F24F 11/63 700/276 |
| 2023/0296301 | A1* | 9/2023 | Taras | F25B 49/02 62/129 |
| 2024/0102681 | A1* | 3/2024 | Knieser | F24F 11/64 |

* cited by examiner

SYSTEMS AND METHODS FOR PREDICTING REFRIGERANT LEAKAGE OF A CRITICALLY CHARGED HVAC/REFRIGERATION SYSTEM

BACKGROUND

The present disclosure relates generally to HVAC/Refrigeration systems. More particularly, the present disclosure relates to systems and methods for predicting refrigerant leakage in critically charged HVAC/Refrigeration systems. Typically, leakage in HVAC/Refrigeration systems is managed on a reactive basis, where existing leaks are identified and subsequently repaired. It would be advantageous to provide a system for predictively identifying and addressing potential refrigerant leaks before they occur, so that leakage of refrigerants to the atmosphere can be minimized or avoided.

SUMMARY

One implementation of the present disclosure is a system for predicting a leak of a HVAC/Refrigeration system, according to some embodiments. In some embodiments, the system includes a cloud computing system and a first HVAC/Refrigeration system. In some embodiments, the first HVAC/Refrigeration system includes a controller configured to at least one of communicate directly with the cloud computing system, or communicate with the cloud computing system through a user device in communication with the controller of the first HVAC/Refrigeration system. In some embodiments, the cloud computing system includes processing circuitry configured to communicate with the first HVAC/Refrigeration system and other HVAC/Refrigeration systems. In some embodiments, the cloud computing system is configured to obtain performance data and health data from the multiple other HVAC/Refrigeration systems. In some embodiments, the processing circuitry is configured to train a neural network to predict a leakage event based on the performance data and the health data. In some embodiments, the processing circuitry is configured to obtain performance data and health data from the first HVAC/Refrigeration system, use the neural network to predict a leak event at the first HVAC/Refrigeration system, and operate a display to provide a notification to a technician or a manager regarding the predicted leak event at the first HVAC/Refrigeration system.

In some embodiments, the performance data includes subcooling data of the other HVAC/Refrigeration systems, and at least one of superheat data or enthalpy data of the other HVAC/Refrigeration systems. In some embodiments, the health data includes an amount of power drawn by the other HVAC/Refrigeration systems.

In some embodiments, the display is a display screen of a smartphone of the technician. In some embodiments, the notification prompts the technician to perform servicing at the first HVAC/Refrigeration system.

In some embodiments, the neural network is trained to predict the leak event and to predict a severity of the leak event. In some embodiments, the cloud computing system is configured to provide leak data to the neural network to train the neural network based on the leak data.

In some embodiments, the leak data is determined based on a comparison between a subcooling temperature of refrigerant of the other HVAC/Refrigeration systems and a threshold subcooling temperature. In some embodiments, the subcooling temperature is a temperature of the refrigerant of the plurality of other HVAC/Refrigeration systems at at least one of an outlet of a condenser of the other HVAC/Refrigeration systems, an inlet of an expansion valve of the other HVAC/Refrigeration systems, or a position along a tubular member extending between the outlet of the condenser and the inlet of the expansion valve.

In some embodiments, the leak data is obtained based on data provided by a first quantity of refrigerant added to a HVAC/Refrigeration system or a second quantity of refrigerant removed from the HVAC/Refrigeration system. In some embodiments, the data provided by the service tool includes at least one of a measurement of the first quantity or a measurement of the second quantity.

In some embodiments, the leak data includes a difference between (i) the measurement of the first quantity at a first time at which a first service operation is performed, and (ii) the measurement of the second quantity at a second time at which a second service operation is performed. In some embodiments, the second time occurs after the first time.

In some embodiments, the first HVAC/Refrigeration system and the other HVAC/Refrigeration systems are critically charged HVAC/Refrigeration systems. In some embodiments, the neural network is configured to receive subcooling temperature data of the first HVAC/Refrigeration system as an input and predict the leak event of the first HVAC/Refrigeration system before or at a beginning of the leak event.

Another implementation of the present disclosure is a system for predicting a leak of a HVAC/Refrigeration system, according to some embodiments. In some embodiments, the system includes a critically charged HVAC/Refrigeration system configured to circulate a refrigerant to cool a space, and processing circuitry. In some embodiments, the processing circuitry is configured to obtain the subcooling data from the critically charged HVAC/Refrigeration system. In some embodiments, the processing circuitry is configured to predict a leak event by providing the subcooling data as an input to a neural network. In some embodiments, the neural network is trained using historical data of one or more subcooling parameters of a plurality of critically charged HVAC/Refrigeration systems. In some embodiments, the processing circuitry is configured to operate a display to provide a notification to a technician or a manager regarding the predicted leak event at the critically charged HVAC/Refrigeration system.

In some embodiments, the critically charged HVAC/Refrigeration system includes a compressor, a condenser, an expansion valve, and an evaporator. In some embodiments, the compressor is configured to compress and discharge the refrigerant through a piping system. In some embodiments, the condenser is fluidly coupled on the piping system. In some embodiments, the condenser is configured to receive the refrigerant from the compressor and condense the refrigerant as the refrigerant passes through the condenser. In some embodiments, the expansion valve is fluidly coupled on the piping system and is configured to receive the refrigerant from the condenser and decrease a pressure of the refrigerant as the refrigerant passes through the expansion valve. In some embodiments, the evaporator is fluidly coupled on the piping system and is configured to receive the refrigerant from the expansion valve and cool a space as the refrigerant passes through the evaporator. In some embodiments, the evaporator is configured to return the refrigerant to an inlet of the compressor.

In some embodiments, the subcooling data includes at least one of a temperature, a pressure, or an enthalpy of the refrigerant of the critically charged HVAC/Refrigeration system obtained at any of an outlet of the condenser, an inlet of the expansion valve, or a position along a tubular member of the piping system extending between the outlet of the condenser and the inlet of the expansion valve. In some embodiments, the neural network is configured to predict the leak event before the leak event occurs or at a beginning of the leak event based on subcooling data. In some embodiments, the neural network is also configured to receive at least one of superheating data or health data of the critically charged HVAC/Refrigeration system and use at least one of the superheating data or the health data as inputs to predict the leak event.

Another implementation of the present disclosure is a method for predicting a leak of a HVAC/Refrigeration system, according to some embodiments. In some embodiments, the method includes obtaining historical subcooling data from critically charged HVAC/Refrigeration systems. In some embodiments, the method also includes identifying one or more leak events of the critically charged HVAC/Refrigeration systems based on the historical subcooling data. In some embodiments, the method also includes training a neural network to predict a leak event based on the historical subcooling data that precedes the identified leak events. In some embodiments, the method includes predicting, using the trained neural network, a leak event at a currently operating critically charged HVAC/Refrigeration system based on subcooling data obtained from the currently operating critically charged HVAC/Refrigeration system. In some embodiments, the method includes notifying a technician regarding the predicted leak event.

In some embodiments, the critically charged HVAC/Refrigeration systems and the currently operating critically charged HVAC/Refrigeration system each include a compressor, a condenser, an expansion valve, and an evaporator. In some embodiments, the compressor is configured to compress and discharge the refrigerant through a piping system. In some embodiments, the condenser is fluidly coupled on the piping system, the condenser configured to receive the refrigerant from the compressor and condense the refrigerant as the refrigerant passes through the condenser. In some embodiments, the expansion valve is fluidly coupled on the piping system and is configured to receive the refrigerant from the condenser and decrease a pressure of the refrigerant as the refrigerant passes through the expansion valve. In some embodiments, the evaporator is fluidly coupled on the piping system and is configured to receive the refrigerant from the expansion valve and cool a space as the refrigerant passes through the evaporator. In some embodiments, the evaporator is configured to return the refrigerant to an inlet of the compressor. In some embodiments, the subcooling data includes at least one of a temperature, a pressure, or an enthalpy of the refrigerant of the critically charged HVAC/Refrigeration system obtained at any of an outlet of the condenser, an inlet of the expansion valve, or a position along a tubular member of the piping system extending between the outlet of the condenser and the inlet of the expansion valve. In some embodiments, the trained neural network is configured to predict the leak event before the leak event occurs or at a beginning of the leak event based on subcooling data.

Another implementation of the present disclosure is a method for leakage prognostic of a critically charged HVAC/Refrigeration unit, according to some embodiments. In some embodiments, the method includes equipping a critically charged HVAC/Refrigeration unit with instrumentation to measure performance data and mechanical health data of the critically charged HVAC/Refrigeration unit. In some embodiments, the method also includes identifying leakage events of the critically charged HVAC/Refrigeration unit based on the performance data and the mechanical health data of the critically charged HVAC/Refrigeration unit. In some embodiments, the method includes performing a root cause analysis of the critically charged HVAC/Refrigeration unit, and building a root cause database using results of the root cause analysis. In some embodiments, the root cause database includes root causes of leakage events and associated performance data and mechanical health data. In some embodiments, the method includes using machine learning and the root cause database to predict if a specific critically charged HVAC/Refrigeration unit will experience a leakage event in the future based on obtained performance data and mechanical health data of the specific critically charged HVAC/Refrigeration unit. In some embodiments, the performance data includes subcooling data, and the mechanical health data includes power consumption data.

In some embodiments, performing the root cause analysis of the critically charged HVAC/Refrigeration unit includes physically inspecting the critically charged HVAC/Refrigeration unit to identify a root cause of the leakage event. In some embodiments, the subcooling data includes a temperature of refrigerant of the critically charged HVAC/Refrigeration system or the specific critically charged HVAC/Refrigeration system after an outlet of a condenser of the critically charged HVAC/Refrigeration system or the specific critically charged HVAC/Refrigeration system.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the Figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the FIGURES, a cloud computing system can obtain performance data and health data from critically charged HVAC/Refrigeration systems. The cloud computing system may train a neural network and use the trained neural network to predict a leak event for leakage prognostics. Outputs of the cloud computing system can be viewed by a system manager or the technician. The systems and methods described herein advantageously facilitate preemptively identifying leakage of HVAC/Refrigeration systems.

Refrigerant Tracking System

Overview

Figure 1:
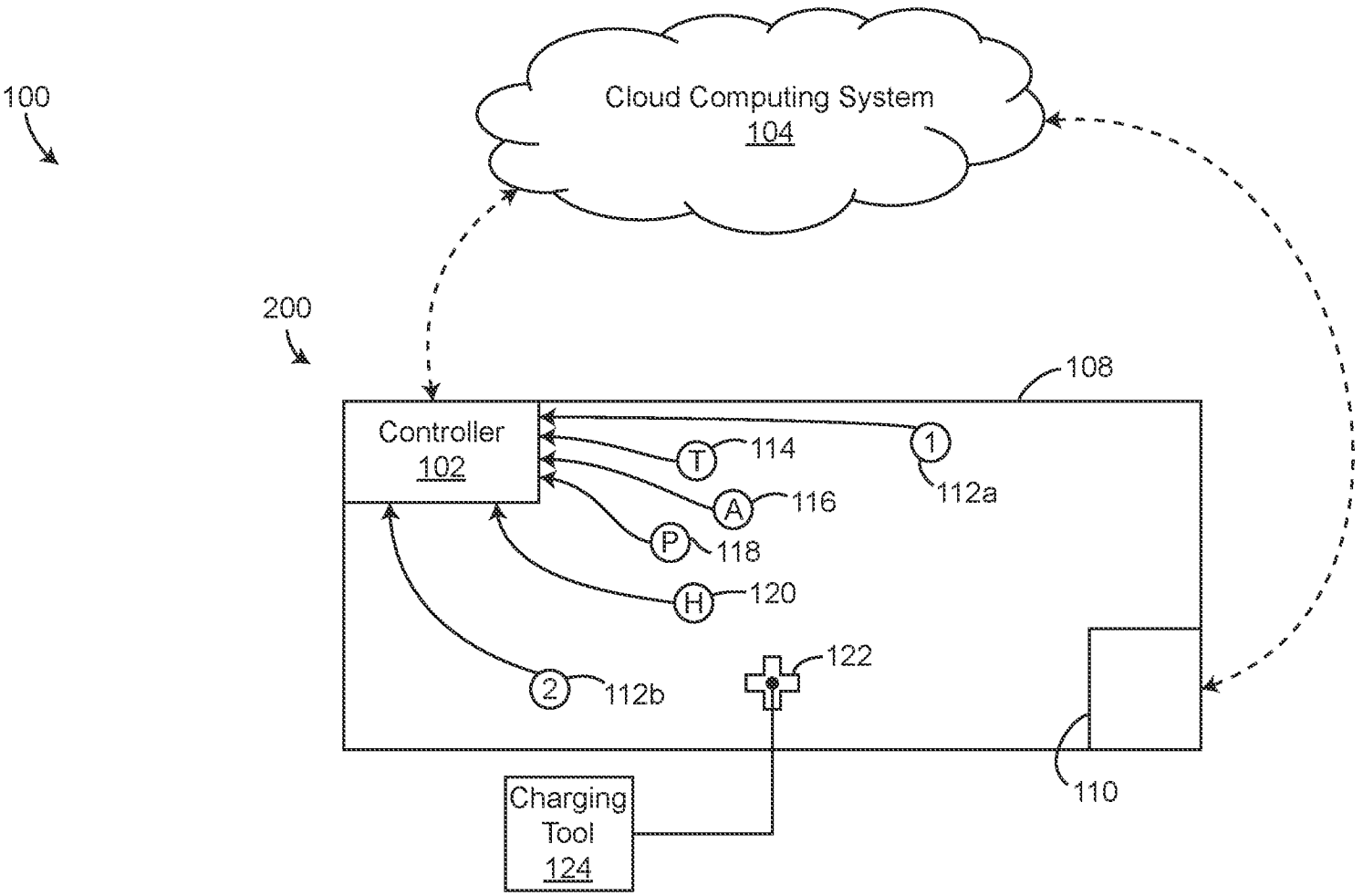
FIG. 1 is a block diagram of a refrigerant tracking system including a charging tool and a HVAC/Refrigeration system, according to some embodiments.

Referring to FIG. 1, a refrigerant tracking system 100 is configured to monitor, track, and report amounts of refrigerant consumed over a lifetime or a portion of lifetime of HVAC/Refrigeration equipment. The refrigerant tracking system 100 may work in combination with a charging tool 124 to track amounts of refrigerant added or removed from the HVAC/Refrigeration system and to determine amounts of refrigerant consumed by the HVAC/Refrigeration equipment over its lifetime, amount of a certain type of refrigerant that has leaked from the HVAC/Refrigeration equipment (e.g., to the environment), etc.

Referring still to FIG. 1, the refrigerant tracking system 100 includes a cloud computing system 104, a critically-charged HVAC/Refrigeration unit 108 (e.g., a HVAC/Refrigeration system, a rooftop HVAC/Refrigeration equipment, a refrigerator, a refrigerated display case, etc.), and the charging tool 124. The HVAC/Refrigeration unit 108 includes a controller 102, one or more temperature sensors 114, one or more amperage sensors 116, one or more pressure sensors 118, one or more humidity sensors 120, and one or more leak detectors 112 (shown as leak detector 112*a* and leak detector 112*b*). The controller 102 is configured to obtain any temperature, pressure, amperage, humidity, etc., from the temperature sensors 114, the amperage sensors 116, the pressure sensors 118, or the humidity sensors 120. The controller 102 is also configured to obtain any leak detection from the leak detectors 112. In some embodiments, the temperature, pressure, or humidity sensor data provided to the controller 102 includes temperature and humidity of a zone which the HVAC/Refrigeration unit 108 operates to cool. In some embodiments, the temperature or pressure is a temperature or pressure of a refrigerant of the HVAC/Refrigeration unit 108 at any position in a HVAC/Refrigeration loop. In some embodiments, the controller 102 is configured to obtain amperage of any compressor of the HVAC/Refrigeration unit 108.

It should be understood that the terms "HVAC/Refrigeration system" or "HVAC/Refrigeration unit" as used herein may refer to any system or equipment that uses a refrigerant as a working fluid to cool or heat a space. In this way, the HVAC/Refrigeration unit 108 may be or include a heating, ventilation, or air-conditioning (HVAC) system or equipment, a heat pump, a refrigerated display case, a cooling system, a cooler, a refrigerator, a freezer, etc.

In some embodiments, the HVAC/Refrigeration unit 108 includes a charging port 122, and refrigerant can be added or removed (e.g., by the charging tool 124) through the charging port 122.

In some embodiments, the controller 102 is configured to communicate with the cloud computing system 104. The cloud computing system 104 can represent multiple servers, processors, processing circuitry, a single server, a single processor, a single processing circuit, etc., configured to perform any of the operations and functions described herein.

Signals or data from the leak detectors 112 can be obtained by the cloud computing system 104 or the controller 102 by serial communications, digital communications, analog or hard-wired communications such as 0-10 VDC, 1-5 VDC, etc.

HVAC/Refrigeration System

Figure 2:
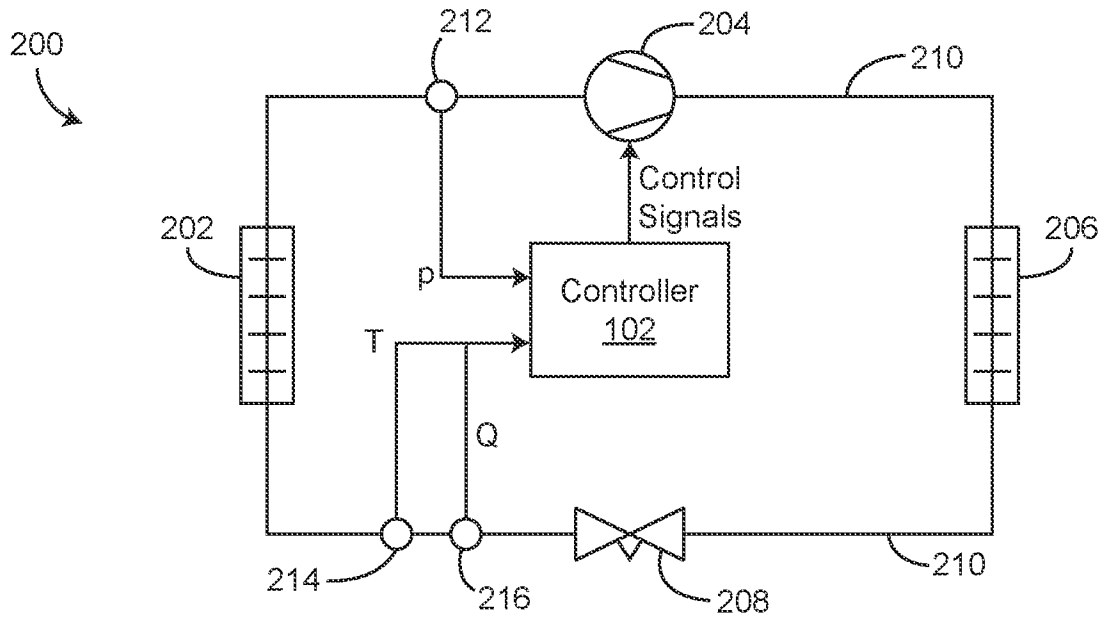
FIG. 2 is a diagram of the HVAC/Refrigeration system of the refrigerant tracking system of FIG. 1, according to some embodiments.

Referring particularly to FIG. 2, a HVAC/Refrigeration system 200 (e.g., a critically charged HVAC/Refrigeration system or unit) is shown, according to some embodiments. The HVAC/Refrigeration system 200 may be included in the HVAC/Refrigeration unit 108, or the HVAC/Refrigeration unit 108 may be a component of the HVAC/Refrigeration system 200, all of which are fluidly coupled with each other in a loop via piping 210 (e.g., hoses, tubular members, conduits, etc.). The HVAC/Refrigeration system 200 is configured to cool a space (e.g., a volume, a HVAC/Refrigeration zone, etc.). The HVAC/Refrigeration system 200 includes a compressor 204, a condenser 206, an expansion valve 208, and an evaporator 202. The compressor 204 is configured to pressurize a refrigerant and drive the refrigerant through piping 210 to the condenser 206. The refrigerant passes through the condenser 206, cools and releases heat, and exits the condenser 206. The refrigerant is then driven through piping 210 to the expansion valve 208. The refrigerant passes through the expansion valve 208 and expands (to thereby cool) before entering the evaporator 202. The refrigerant is then provided to the evaporator 202 to absorb heat from the space to cool the space. After the refrigerant exits the evaporator 202, the refrigerant returns to the compressor 204.

The HVAC/Refrigeration system 200 also includes a pressure sensor 212 positioned on a suction side of the compressor 204. The pressure sensor 212 may be the pressure sensor 118 as shown in FIG. 1 and described in greater detail above. The pressure sensor 212 is configured to provide measurements of pressure of the refrigerant as the refrigerant enters the compressor 204. The HVAC/Refrigeration system 200 also includes a temperature sensor 214 that is positioned along the piping 210 before an inlet of the evaporator 202. The temperature sensor 214 can be the temperature sensor 114. In some embodiments, the temperature sensor 214 is configured to provide a temperature of the refrigerant prior to entry of the evaporator 202 to the controller 102. In some embodiments, the HVAC/Refrigeration system 200 includes a flow rate sensor 216 that is configured to measure a flow rate (e.g., volumetric flow rate, velocity, mass flow rate, etc.) (e.g., downstream of the expansion valve 208) and provide the flow rate (shown as Q) to the controller 102.

It should be understood that the refrigerant may be any type of refrigerant such as R32, 410A, R22, CO2, propane, etc., and the systems and methods described herein can apply to any HVAC/Refrigeration system or multiple HVAC/Refrigeration systems that use the same or different refrigerants.

The controller 102 can be configured to generate control signals for the compressor 204 and operate the compressor 204 based on any of the temperature, pressure, or flow rates obtained from the temperature sensor 214, the pressure sensor 212, or the flow rate sensor 216. In some embodiments, the controller 102 is configured to operate the compressor 204 using a closed loop control scheme (e.g., PID control, PI control, etc.). For example, the controller 102 can be configured to perform various control algorithms. In some embodiments, the charging port 122 is configured to allow the charging tool 124 to fluidly couple with the charging port 122 so that the charging tool 124 can remove refrigerant from the HVAC/Refrigeration system 200 and add new refrigerant from the HVAC/Refrigeration system 200, or add additional refrigerant to the HVAC/Refrigeration system 200.

Leakage Prognostic

Figure 3:
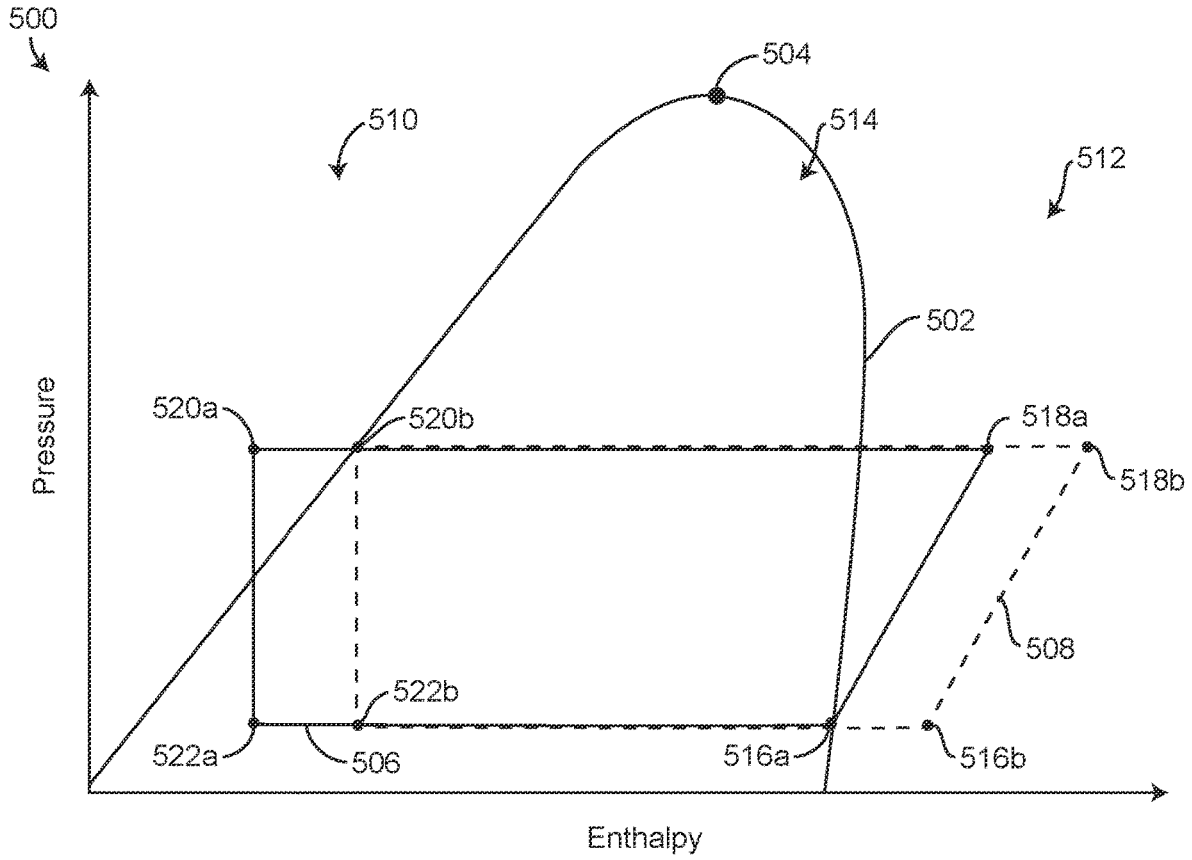
FIG. 3 is a pressure-enthalpy diagram showing the thermodynamic process of the HVAC/Refrigeration system of FIGS. 1-2 before and after a leak has occurred, according to some embodiments.

Referring to FIG. 3, a pressure-enthalpy graph 500 illustrates thermodynamic changes to the refrigerant of the HVAC/Refrigeration system 200 as the refrigerant is circulated through the HVAC/Refrigeration system 200, according to some embodiments. Specifically, the pressure-enthalpy graph 500 illustrates thermodynamic changes that happen to the refrigerant when the HVAC/Refrigeration system 200 is fully charged (e.g., a current level or amount of refrigerant in the HVAC/Refrigeration system 200 is substantially equal to a critical charge amount) as illustrated by path 506, and thermodynamic changes that happen to the refrigerant when the HVAC/Refrigeration system 200 has leaked refrigerant (e.g., when the current level or amount of refrigerant in the HVAC/Refrigeration system 200 is less than the critical charge amount or when a leak is or has occurred at the HVAC/Refrigeration system 200) as illustrated by path 508.

The pressure-enthalpy graph 500 includes a vapor dome 502 that includes a critical point 504. An area within the vapor dome 502 illustrates a liquid-vapor region of the refrigerant, shown as liquid-vapor region 514. An area outside of the vapor dome 502 and to the right of the critical point 504 illustrates a superheated vapor region, shown as superheated vapor region 512. An area outside of the vapor dome 502 and to the left of the critical point 504 illustrates a subcooled region, shown as subcooled region 510. Points along the vapor dome 502 to the left of the critical point 504 are saturated liquid points. Points along the vapor dome 502 to the right of the critical point 504 are saturated vapor points.

For conditions when a leak has not occurred, the refrigerant undergoes thermodynamic changes according to the path 506. A first point 516*a*, which is shown on the vapor dome 502 (e.g., along a saturated vapor portion of the vapor dome 502) illustrates the thermodynamic state of the refrigerant as the refrigerant enters the compressor 204. As the refrigerant is pressurized by the compressor 204, the pressure and enthalpy of the refrigerant increases. A second point 518*a* of the path 506 illustrates a thermodynamic state of the refrigerant as the refrigerant exits the compressor 204 after being pressurized. As shown in FIG. 3, the second point 518*a* lies in the superheated vapor region with increased pressure relative to the first point 516*a*.

When the refrigerant enters the condenser 206, the refrigerant is at or substantially at the point 518*a*. As the refrigerant passes through the condenser 206, enthalpy of the refrigerant decreases, while pressure of the refrigerant remains substantially constant. Temperature of the refrigerant also decreases as the refrigerant passes through the condenser 206. The refrigerant transitions into a subcooled liquid state (e.g., the subcooled region 510) as the refrigerant exits the condenser 206, shown as point 520*a*.

When the refrigerant enters the expansion valve 208, the refrigerant is at or substantially at the point 520*a*. As the refrigerant passes through the expansion valve 208, the refrigerant expands (e.g., the pressure decreases while the enthalpy remains substantially the same), thereby causing further cooling and transitioning the refrigerant into a vapor liquid mixture, as represented by a point 522*a*. Once the refrigerant achieves the thermodynamic state shown at point 522*a*, the refrigerant can be used to cool the space (e.g., by being transferred through the evaporator 202).

As the refrigerant passes through the evaporator 202, the refrigerant cools the space (e.g., heat transfer from the air of the space to the refrigerant) and thereby increases in temperature. As the refrigerant increases in temperature, the refrigerant also increases in enthalpy while the pressure of the refrigerant remains substantially the same. The refrigerant increases in temperature and enthalpy until the refrigerant achieves the thermodynamic state as shown at point 516*a* (e.g., as the refrigerant exits the evaporator 202). The point 516*a* is the starting point of the process illustrated by path 506.

When a leak occurs, the efficiency or cooling ability of the HVAC/Refrigeration system 200 decreases, which results in the points 516*a*-522*a* of the path 506 being shifted to increased enthalpy, as illustrated by the path 508. The path 508 is defined by points 516*b*-522*b* which illustrate the new points (shifted with increased enthalpy and increased temperature) due to leakage of the HVAC/Refrigeration system 200. For example, the point 516*b* corresponds to the point 516*a* (after a leak has occurred), the point 518*b* corresponds to the point 518*a*, the point 520*b* corresponds to the point 520*a*, and the point 522*b* corresponds to point 522*a*. The path 508 relative to the path 506 may illustrate anomalous performance data that is indicative of a leakage event.

Figure 5:
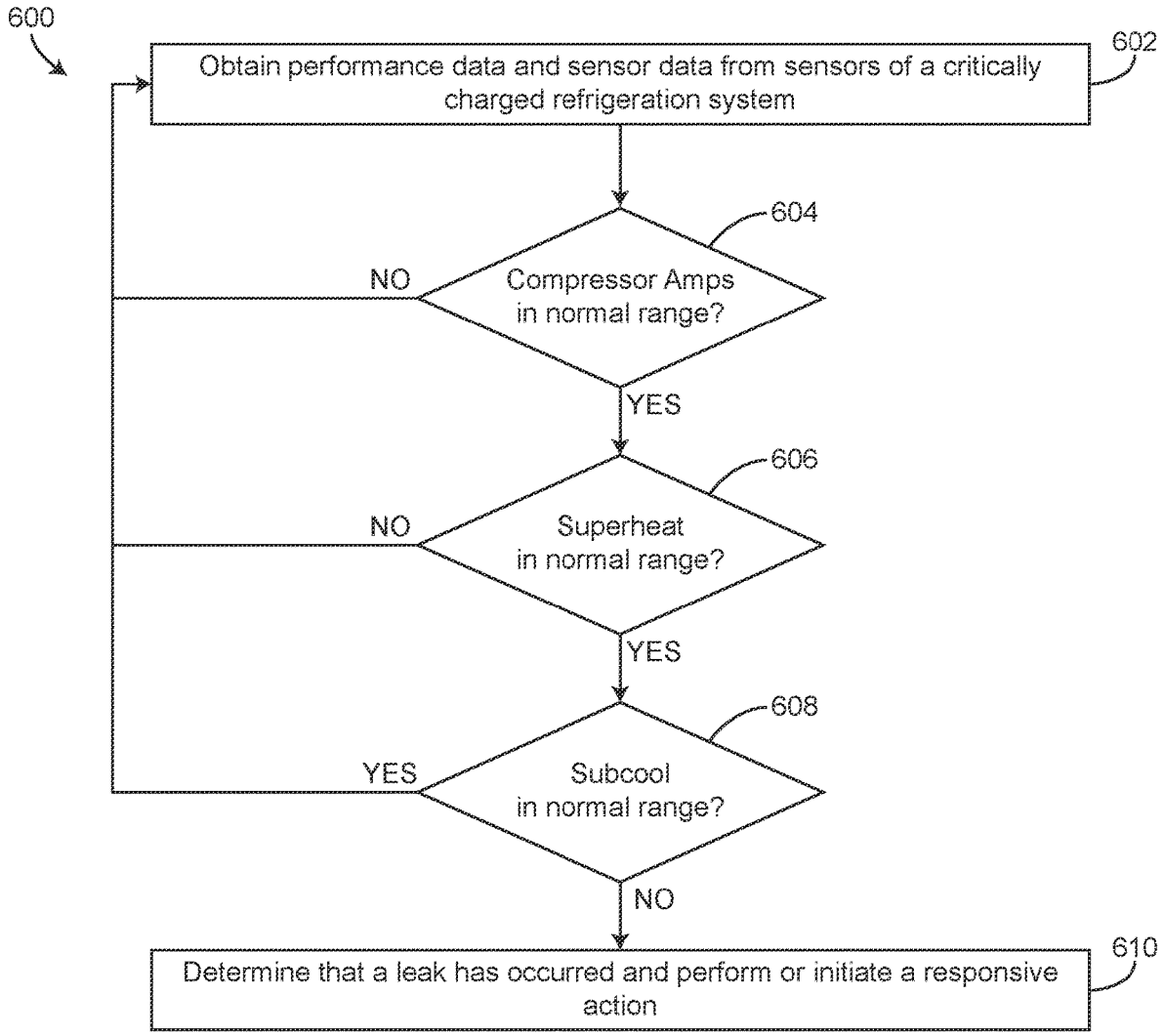
FIG. 5 is a flow diagram of a process for detecting if a leak has occurred at a critically charged HVAC/Refrigeration system or unit using subcooling data, according to some embodiments.

When the leak occurs, the temperature of the refrigerant in the subcooling region 510 (e.g., the point 520*a*) as the refrigerant leaves the condenser 206 or before the refrigerant enters the expansion valve 208 may increase relative to if a leak had not occurred and the refrigerant level is normal (as illustrated in FIG. 5). Accordingly, monitoring any decrease in the subcooling temperature of the refrigerant (e.g., the temperature of the refrigerant as the refrigerant exits the condenser 206, before the refrigerant enters the expansion valve 208, or along the piping 210 between the exit of the condenser 206 and the entrance of the expansion valve 208), provides an effective indicator for the presence of a refrigerant leak in the system.

Figure 4:
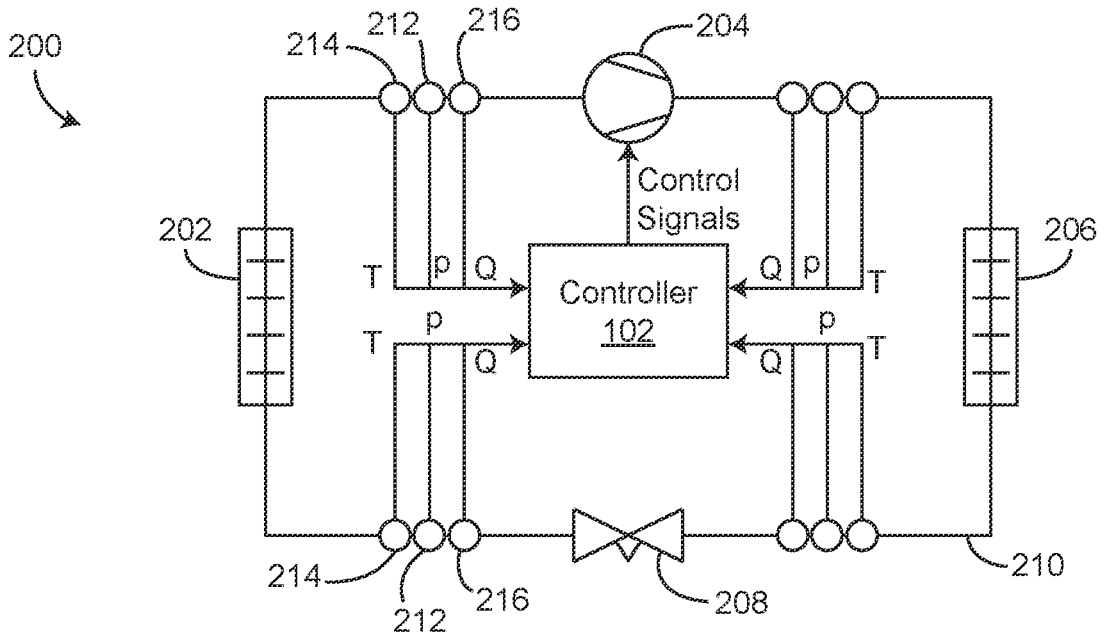
FIG. 4 is a diagram of the HVAC/Refrigeration system of FIG. 2 including multiple sensors, according to some embodiments.

As shown in FIG. 4, the HVAC/Refrigeration system 200 may include temperature sensors 214, pressure sensors 212, and/or flow rate sensors 216 between each of the components of the HVAC/Refrigeration system. The controller 102 may obtain temperature and pressure values of the refrigerant from each of the different positions along the piping 210 so that the controller 102 can monitor the thermodynamic conditions at each of the points or corners 516*a*-522*a* along the path 506. In particular, the controller 102 may monitor the conditions or thermodynamic properties (e.g., temperature and pressure) of the refrigerant as the refrigerant exits the condenser 206, or before the refrigerant enters the expansion valve 208.

The controller 102 may also obtain power draw (e.g., electrical current measured from: the compressor 204, from a fan of the condenser 206, from a fan of the evaporator 202, etc.) and use the power drawn to determine a health or life of the components of HVAC/Refrigeration system 200 to prevent false positives of leak detection or prediction. In some embodiments, the controller 102 or a cloud computing system are configured to perform leakage prognostics or leakage detection.

Referring to FIG. 5, a process 600 for detecting if a leak has occurred using subcooling data (e.g., a temperature of the refrigerant at a location along the HVAC/Refrigeration system 200 where subcooling is expected) includes steps 602-610, according to some embodiments. The process 600 may be performed by the controller 102 of the HVAC/Refrigeration system 200, or by the cloud computing system 104. In some embodiments, the critically charged HVAC/Refrigeration system is the HVAC/Refrigeration system 200.

Process 600 includes obtaining performance data and sensor data of a critically charged HVAC/Refrigeration system (step 602), according to some embodiments. In some embodiments, step 602 includes obtaining sensor data from any of the sensors of the HVAC/Refrigeration system (e.g., the HVAC/Refrigeration system 200). The sensor data may include any temperature, pressure, humidity, enthalpy, etc., values or readings of the refrigerant or a space that the HVAC/Refrigeration system cools. The performance data can include any amperage, power draw, energy consumption, etc., of a compressor, condenser fan, evaporator fan, etc., of the HVAC/Refrigeration system. Step 602 may be performed by the controller 102 of the HVAC/Refrigeration system 200, the cloud computing system 104, etc.

Process 600 includes determining if compressor amperage (or other power draw metric) is within a normal range of operation (step 604), according to some embodiments. In some embodiments, the cloud computing system 104 or the controller 102 use the compressor amperage of the compressor of the HVAC/Refrigeration system in comparison to a normal amperage range to account for life of the HVAC/Refrigeration system. In response to the compressor amperage being within normal range (step 604, "YES"), process 600 proceeds to step 606. In response to the compressor amperage being outside of the normal range (step 604, "NO"), process 600 returns to step 602.

Process 600 includes determining if superheat of the refrigerant is in a normal range (step 606), according to some embodiments. In some embodiments, the cloud computing system 104 or the controller 102 use sensor data of the refrigerant at a superheat location (e.g., using values of temperature, pressure, enthalpy, etc.) of the refrigerant in the HVAC/Refrigeration system to account for life of the HVAC/Refrigeration system and limit false positive detection of leakage. In some embodiments, step 606 includes comparing superheat of the refrigerant at the superheat location (e.g., at an outlet of the compressor 204, at an inlet of the condenser 206, etc.) to a normal range of values. In some embodiments, the superheat is a temperature value of the refrigerant, a pressure value of the refrigerant, an enthalpy value of the refrigerant, etc. In response to the superheat being within the normal range (step 606, "YES"), process 600 proceeds to the step 608. In response to the superheat being outside of the normal range (step 606, "NO"), process 600 returns to step 602.

Process 600 includes determining if subcool of the refrigerant is in a normal range (step 608) or greater than or less than a threshold, according to some embodiments. In some embodiments, step 608 includes comparing a subcooling property (e.g., temperature, pressure, humidity, enthalpy, etc.) of the refrigerant to a corresponding range or threshold. In some embodiments, the subcool is any sensor value or determined value of the refrigerant as the refrigerant exits the condenser 206, before the refrigerant enters the expansion valve 208, or along the piping 210 between the condenser 206 and the expansion valve 208. If the subcooling of the refrigerant is not in a normal range, or the property of subcooling exceeds or is less than a threshold (e.g., the temperature of the refrigerant is greater than a threshold temperature), the process 600 determines that a leak has occurred (e.g., that refrigerant is currently low) and proceeds to step 610 (step 608, "NO"). If the subcooling is in the normal range (step 608, "YES"), process 600 returns to step 602. In this way, sensor data of the refrigerant of the critically charged HVAC/Refrigeration system (e.g., the HVAC/Refrigeration system 200) as the refrigerant exits the condenser 206, at the inlet of the expansion valve 208, directly before the expansion valve 208, along the piping 210 between the outlet or exit of the condenser 206 and the entrance of inlet of the expansion valve 208, etc., can be used to identify if refrigerant is low in the critically charged HVAC/Refrigeration system due to a leakage event.

Figure 6:
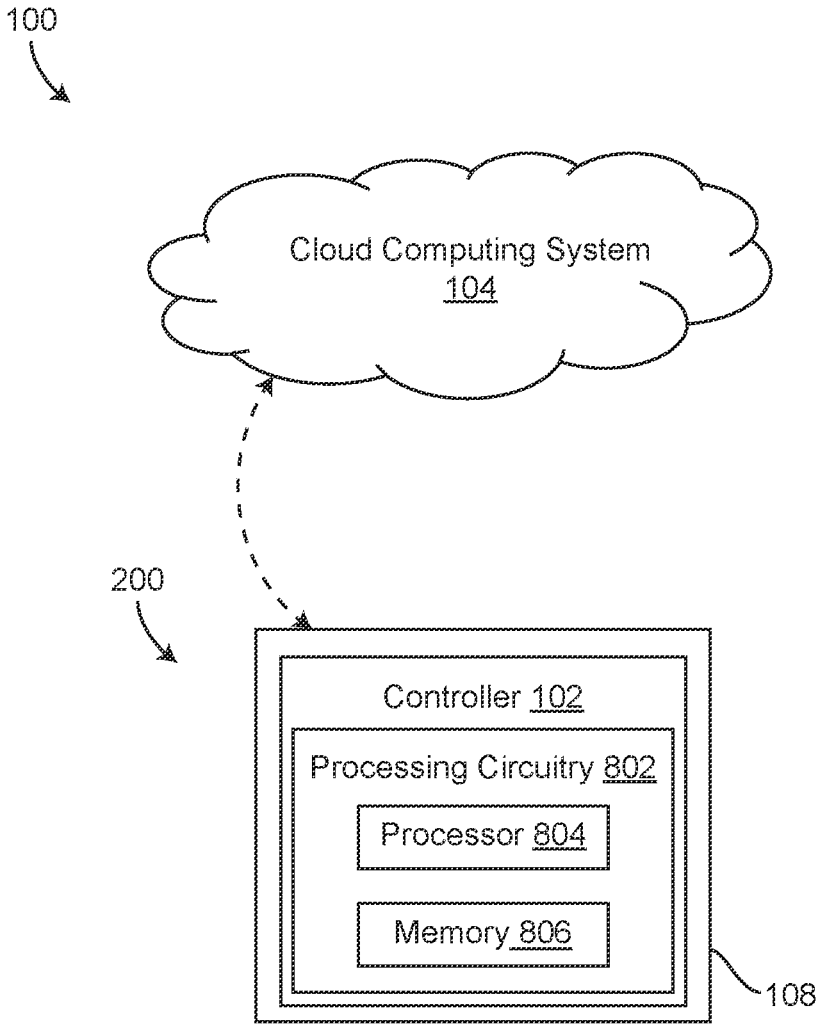
FIG. 6 is a block diagram of the refrigerant tracking system of FIG. 1, according to some embodiments.

Referring to FIG. 6, the controller 102 is shown to include processing circuitry 802 including a processor 804 and memory 806. Processing circuitry 802 can be communicably connected to a communications interface such that processing circuitry 802 and the various components thereof can send and receive data via the communications interface. Processor 804 can be implemented as a general purpose processor, an application specific integrated circuit (ASIC), one or more field programmable gate arrays (FPGAs), a group of processing components, or other suitable electronic processing components.

Memory 806 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 806 can be or include volatile memory or non-volatile memory. Memory 806 can include database components, object code components, script components, or any other type of information structure for supporting the various activities and information structures described in the present application. According to some embodiments, memory 806 is communicably connected to processor 804 via processing circuitry 802 and includes computer code for executing (e.g., by processing circuitry 802 and/or processor 804) one or more processes described herein.

In some embodiments, the controller 102 is implemented within a single computer (e.g., one server, one housing, etc.). In various other embodiments, controller 102 can be distributed across multiple servers or computers (e.g., that can exist in distributed locations). The controller 102 (e.g., the processing circuitry 802) may receive sensor feedback from system sensors of the HVAC/Refrigeration system 200. In some embodiments, the controller 102 is configured to determine an amount of refrigerant added or removed from the HVAC/Refrigeration system 200.

Referring still to FIGS. 1-2, the refrigerant tracking system 100 can be configured to perform leakage prognostic to identify if a HVAC/Refrigeration system (e.g., HVAC/Refrigeration system 200) is leaking. In some embodiments, the controller 102, or the cloud computing system 104 can be configured to use performance data obtained from system sensors (e.g., temperature sensor 114, the pressure sensors 118, the amperage sensors 116, the humidity sensors 120, the leak sensors 112, the amount of refrigerant added or removed, etc.) of the HVAC/Refrigeration system 200, and equipment health data to determine if the HVAC/Refrigeration system 200 is leaking. In some embodiments, the performance data includes subcooling data, superheating data, enthalpy, etc., of the HVAC/Refrigeration system 200. In some embodiments, the equipment health data includes power drawn (e.g., amps) by the compressor 204 of the HVAC/Refrigeration system 200. In some embodiments, the controller 102, or the cloud computing system 104 are configured to use the performance data to identify if a leak has occurred, and/or a severity of the leak that has occurred at the HVAC/Refrigeration system 200 (e.g., leak data). Health data can be obtained by the cloud computing system 104 from the HVAC/Refrigeration system 200, or from individual components of the HVAC/Refrigeration system 200.

In some embodiments, the leak data is used by the cloud computing system 104 to compare the leak data to leak data of other HVAC/Refrigeration systems. In some embodiments, the cloud computing system 104 is configured to cross reference equipment inventory of a database with leak data of the HVAC/Refrigeration system 200. In some embodiments, the database includes historical or previously calculated leak data. The cloud computing system 104 can user a neural network to analyze and assess a trend of the leak data to identify if leakage is increasing at the HVAC/Refrigeration system 200, or to determine conditions that occur prior to the HVAC/Refrigeration system 200 leaking. In some embodiments, the neural network is configured to use the database as training data to predict leakage of the HVAC/Refrigeration systems given different conditions (e.g., operational data, refrigerant levels, amounts of refrigerant added, etc.) that precede or cause leakage of refrigerant at a HVAC/Refrigeration system. The neural network can also use data from any of the HVAC/Refrigeration systems 200 after a leakage event has occurred, and identify (e.g., based on sub-cooling data, enthalpy data, etc.) one or more pre-anomaly events. The neural network can be trained based on the data in the database so that the neural network can use newly obtained data from the HVAC/Refrigeration system 200 (e.g., leak data, the first quantity, the second quantity, the operational data, performance data, etc.) to predict leakage of the HVAC/Refrigeration systems before leakage even occurs.

In some embodiments, the neural network is trained based on differences between the amount of refrigerant added, and the amount of refrigerant removed at the system 200 between subsequent servicing operations, and any performance or health data obtained for the time interval between the subsequent servicing operations. In this way, the neural network can be trained to predict, based on newly obtained performance or health data and an amount of operating time, an amount of refrigerant that is expected to leak from the system 200 (e.g., an amount or difference between an amount or quantity of refrigerant previously added and an amount or quantity of refrigerant that is subsequently removed at a later time). The predicted leakage can be provided in a graphical user interface (GUI) (e.g., the predictions) so that a technician or a system manager can identify if a particular HVAC/Refrigeration system has a high likelihood of a leakage event occurring in the near future, based on current and historical performance and/or equipment health monitoring of the particular HVAC/Refrigeration system. Leakage can also be predicted based on changes in performance of any unit. For example, the cloud computing system 104 may track a coefficient of performance of a particular HVAC/Refrigeration unit or system over time, and if the coefficient of performance significantly decreases, the leakage prognostics may determine that a leak has occurred at the particular HVAC/Refrigeration unit or system. In some embodiments, the controllers 102 of various HVAC/Refrigeration systems 200 are configured to report performance and/or health data to the cloud computing system 104 in real-time or near real-time so that the cloud computing system 104 can detect if a leak has occurred or is expected to occur.

In some embodiments, the cloud computing system 104 is configured to use the subcooling data to predict a leakage event at a critically charged HVAC/Refrigeration system before the leakage event occurs. For example, the cloud computing system 104 can use historical subcooling data (e.g., temperature, pressure, enthalpy, quality, humidity, etc., of the refrigerant or any combination thereof, at any of or any combination of an outlet of the condenser 206, an inlet of the expansion valve 208, a position along the piping 210 between the outlet of the condenser 206 and the inlet of the expansion valve 208) from a population of critically charged HVAC/Refrigeration systems 200 to train a neural network that predicts a leakage event based on subcooling data of a critically charged HVAC/Refrigeration system 200 (e.g., current values, trends, etc.). In some embodiments, the neural network is trained to identify specific values, trends, behaviors, interrelationships, etc. (e.g., anomalies), of the subcooling data that occurs before a leakage event. In this way, once the neural network is trained, the subcooling data from a different HVAC/Refrigeration system 200 can be obtained from the controller 102 of the different HVAC/Refrigeration system 200 and used by the cloud computing system 104 to determine if a leakage event is predicted to occur given the subcooling data. Advantageously, the subcooling data may preemptively indicate a leakage event, which may be predicted by the neural network that is trained based on historical subcooling data obtained from a population of critically charged HVAC/Refrigeration system 200. The neural network can also be used to identify when a leakage event first begins to occur (e.g., based on the subcooling data) so that the HVAC/Refrigeration system can be maintained or fixed before the leakage event affects performance of the HVAC/Refrigeration system.

Figure 7:
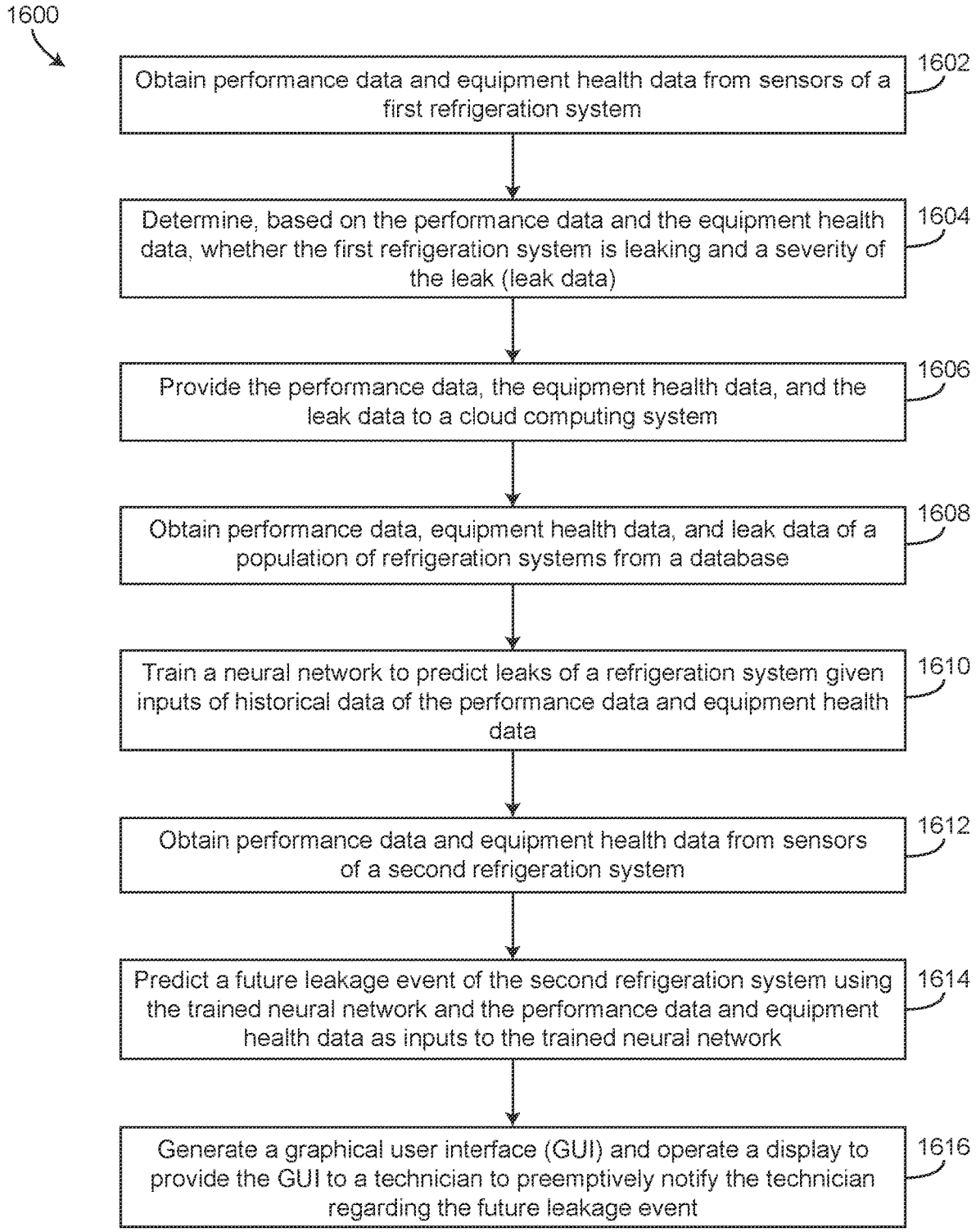
FIG. 7 is a flow diagram of a process for predicting if a leak will occur at a HVAC/Refrigeration system and notifying a technician, according to some embodiments.

Referring to FIG. 7, a process 1600 for performing leakage prognostics is shown, according to some embodiments. The process 1600 may be performed by the refrigerant tracking system 100 in order to predict when a leak event will occur at a HVAC/Refrigeration system. The process 1600 includes steps 1602-1616. In some embodiments, the process 1600 is performed to train a neural network based on population data of various HVAC/Refrigeration systems, so that the neural network can predict a leakage event at a particular HVAC/Refrigeration system, and report the predicted leakage event to a system administrator or a technician. The reported leakage event that is predicted to occur may prompt inspection of the HVAC/Refrigeration system or the unit so that the unit can be repaired, replaced, serviced, etc. Advantageously, the systems and methods described herein facilitate preemptively repairing HVAC/Refrigeration units so that refrigerant does not leak, thereby improving an environmental impact of HVAC/Refrigeration systems.

Process 1600 includes obtaining performance data and equipment health data from sensors of a first HVAC/Refrigeration system (step 1602), according to some embodiments. In some embodiments, the first HVAC/Refrigeration system is the HVAC/Refrigeration system 200 as described in greater detail above with reference to FIGS. 1-2 (e.g., a critically charged HVAC/Refrigeration system). In some embodiments, the performance data and equipment health data are obtained from sensors of the first HVAC/Refrigeration system. A controller of the refrigeration system 200 (e.g., controller 102) may establish communication with a cloud computing system (e.g., the cloud computing system 104) and report performance data or equipment health data to the cloud computing system.

Process 1600 includes determining, based on the performance data and the equipment health data, whether the first HVAC/Refrigeration system is leaking and a severity of the leak (e.g., leak data) (step 1604), according to some embodiments. In some embodiments, step 1604 is performed at the controller of the HVAC/Refrigeration system (e.g., controller 102). In some embodiments, step 1604 is performed at the cloud computing system 104. In some embodiments, the performance data includes subcooling, superheat, or enthalpy data of the first HVAC/Refrigeration system. In some embodiments, the equipment health data includes power drawn (e.g., amps) by the first HVAC/Refrigeration system. In some embodiments, step 1604 includes using an expected amount of power drawn to result in a particular value or range of subcooling, superheat, or enthalpy data. If an excessive amount of power (e.g., an amount of power that exceeds a maximum threshold) is required by the HVAC/Refrigeration system to achieve subcooling, superheat, or enthalpy, step 1604 can include determining that a leak has occurred. A degree to which the amount of power drawn by the first HVAC/Refrigeration system exceeds the maximum threshold may indicate a severity of the leak. Similarly, step 1604 can include monitoring any of the subcooling, superheat, or enthalpy, and comparing values of the subcooling, superheat, or enthalpy to reference ranges for a particular power draw of the first HVAC/Refrigeration system. If the subcooling, superheat, or enthalpy are outside of the reference ranges, step 1604 may identify that a leak has occurred at the first HVAC/Refrigeration system. In some embodiments, a degree to which the subcooling, superheat, or enthalpy are outside of the reference ranges indicates the severity of the leak. The leak data includes both the identification of the leak, and the severity of the leak as determined in step 1602.

Step 1604 can alternatively be performed based on data obtained from a charging tool (e.g., the charging tool 124), according to some embodiments. In some embodiments, the charging tool provides measures of a quantity of refrigerant that is removed from a HVAC/Refrigeration system, and a quantity of refrigerant that is added to the HVAC/Refrigeration system. In some embodiments, the controller 102 or the cloud computing system 104 are configured to perform step 1604 by obtaining the quantities of refrigerant from the charging tool 124, and determining an amount of refrigerant that has leaked between subsequent servicing operations (e.g., of the first HVAC/Refrigeration system, or a population of HVAC/Refrigeration systems). In some embodiments, step 1604 includes determining the difference between currently or recently amount of refrigerant removed from a HVAC/Refrigeration system and amount of refrigerant previously added to the HVAC/Refrigeration system. In some embodiments, the difference between recently removed amount of refrigerant and previously added amount of refrigerant of the first HVAC/Refrigeration system is used as the leak data. In some embodiments, if the difference exceeds a threshold amount, this indicates that the first HVAC/Refrigeration system was leaking. In some embodiments, step 1604 includes operating the charging tool 124 (e.g., connecting, operating to remove refrigerant, operating to added new refrigerant, etc.) and obtaining amounts of refrigerant added or removed. In some embodiments, at each service or charging operation, the charging tool 124 is operated to fill the first HVAC/Refrigeration system (e.g., the system 200) to a full level, and therefore an amount added at each servicing operation is an amount of refrigerant that has leaked from the system, which may be used as the leak data.

Process 1600 includes providing the performance data, the equipment health data, and the leak data to a cloud computing system (step 1606), according to some embodiments. In some embodiments, step 1606 is performed by the controller 102 which establishes communication with the cloud computing system 104. Step 1606 can include transmitting via a cellular network, a wireless network, etc., the performance data, the equipment health data, and the leak data to the cloud computing system. In some embodiments, step 1606 also includes obtaining the results of a physical or on-site root cause analysis of one or more of the population of HVAC/Refrigeration systems. For example, when a HVAC/Refrigeration system leaks or is determined to be experiencing a leak event (as identified in step 1604), a technician may be dispatched to the HVAC/Refrigeration system that is leaking to fix the leak and recharge the system. The technician may also perform a root cause analysis to identify which component of the HVAC/Refrigeration has failed, or, more generally, to identify the root cause of the leak. In some embodiments, the technician can provide an input to the cloud computing system 104 regarding the root cause of the leak event.

In some embodiments, steps 1602-1606 are performed repeatedly for the first HVAC/Refrigeration system at different dates or times in order to build up historical data or training data. Steps 1602-1606 can also be performed for other HVAC/Refrigeration systems across an entire population of HVAC/Refrigeration systems (e.g., including similar or different types of HVAC/Refrigeration systems). The performance data, the equipment health data, and the leak data can be collected into a database for use in training a neural network, for performing statistical analysis, for performing regression, for analyzing or identifying trends, etc. Process 1600 can also include an additional step of writing any of the performance data, the equipment health data, and the leak data to a database of the cloud computing system, or a database with which the cloud computing system is configured to communicate. In some embodiments, repeating step 1606 also results in the development of a root cause database. The root cause database may be developed over time and can facilitate identification of leakage events before they occur, as well as the identification of which part of the HVAC/Refrigeration system is currently failing, or is the root cause of the leakage event before the leakage event occurs.

Process 1600 includes obtaining performance data, equipment health data, and leak data of a population of HVAC/Refrigeration systems from a database (step 1608), according to some embodiments. In some embodiments, step 1608 is performed by the cloud computing system 104 by retrieving data from the database. The population of HVAC/

Refrigeration systems may include any number of HVAC/Refrigeration systems grouped by type, location, environment, etc. In some embodiments, the performance data, the equipment health data, and the leak data is historical data that is stored in the database for the population of HVAC/Refrigeration systems. In some embodiments, step 1608 also includes obtaining root cause data as a result of physical inspections at units of the population that have undergone a leak event.

Process 1600 includes training a neural network to predict leaks of a HVAC/Refrigeration system given inputs of historical data of the performance data and equipment health data (step 1610), according to some embodiments. In some embodiments, the neural network is trained based on the performance data, the equipment health data, and the leak data obtained in step 1608. In some embodiments, the neural network is also trained based on models of the HVAC/Refrigeration system, or different neural networks are trained for the historical data of the performance data, the equipment health data, and the leak data. The neural network may use the historical data as training data to determine a relationship between (i) the performance data, the equipment health data, and (ii) the leak data. In some embodiments, the neural network uses historical performance data and equipment health data that precedes a leak event (e.g., as indicated by the leak data) so that the neural network is trained to predict a leak event. The neural network may be a convolutional neural network (CNN), an artificial neural network (ANN), a recurrent neural network (RNN), etc. In some embodiments, step 1610 uses any machine learning or artificial intelligence technique to determine a relationship or train a model to predict a leak event based on performance data and equipment health data. In some embodiments, the neural network is also trained using the root cause database as developed in steps 1606-1608 (described in greater detail above) so that the neural network can also identify a root cause of the leakage event prior to the leakage event even occurs.

Process 1600 includes obtaining performance data and equipment health data from sensors of a second HVAC/Refrigeration system (step 1612), according to some embodiments. In some embodiments, step 1612 is performed the same as or similarly to step 1602 but for a different HVAC/Refrigeration system. In some embodiments, step 1612 is performed for a HVAC/Refrigeration system for which it is desired to determine if a leak event will occur in the future. Step 1612 can also include providing the performance data and the equipment health data (e.g., for a current timestep, or for a previous timestep) to the cloud computing system (e.g., cloud computing system 104).

Process 1600 includes predicting a future leakage event of the second HVAC/Refrigeration system using the trained neural network and the performance data and equipment health data as inputs to the trained neural network (step 1614), according to some embodiments. In some embodiments, step 1614 is performed by the cloud computing system 104, or by the neural network. The trained neural network uses the performance data and the equipment health data as inputs to predict the future leakage event, a time at which the future leakage event will likely occur, etc. Advantageously, the trained neural network facilitates identifying conditions (e.g., in the performance data and/or equipment health data) that are commonly followed by a leakage event, or that indicate that a leak event has already occurred. In some embodiments, step 1614 also includes identifying a root cause of the predicted future leakage event (e.g., which component is currently failing or about to cause the future leakage event). In some embodiments, leakage events can be predicted when overall performance of the system is degrading (e.g., insufficient cooling is occurring), but the health of each individual component is remaining unchanging (e.g., not degrading). When the degradation of the overall system begins to degrade but the health of individual components does not degrade, this can indicate that refrigerant is beginning to leak.

Process 1600 includes generating a GUI and operating a display to provide the GUI to a technician to preemptively notify the technician regarding the future leakage event (step 1616), according to some embodiments. In some embodiments, step 1616 is performed by the cloud computing system. The GUI can include an alert or a notification and can be provided to or accessible by the technician or a system manager. For example, the GUI may be a webpage that is accessible to a manager so that the manager can monitor which HVAC/Refrigeration systems are likely to leak and require servicing. In some embodiments, the GUI includes an alert or notification to the technician or the system manager to initiate servicing at the second HVAC/Refrigeration system if the results of step 1614 indicate that a leakage event is predicted to occur. In some embodiments, step 1616 includes automatically scheduling a servicing operation (e.g., notifying a technician on their smartphone or user device, adding a servicing time to their calendar, etc.). In some embodiments, if the predicted severity of the leakage event exceeds a threshold, step 1616 includes notifying (e.g., on the GUI) that one or more components of the second HVAC/Refrigeration system should be replaced, or that the entire HVAC/Refrigeration system should be replaced.

Figure 8:
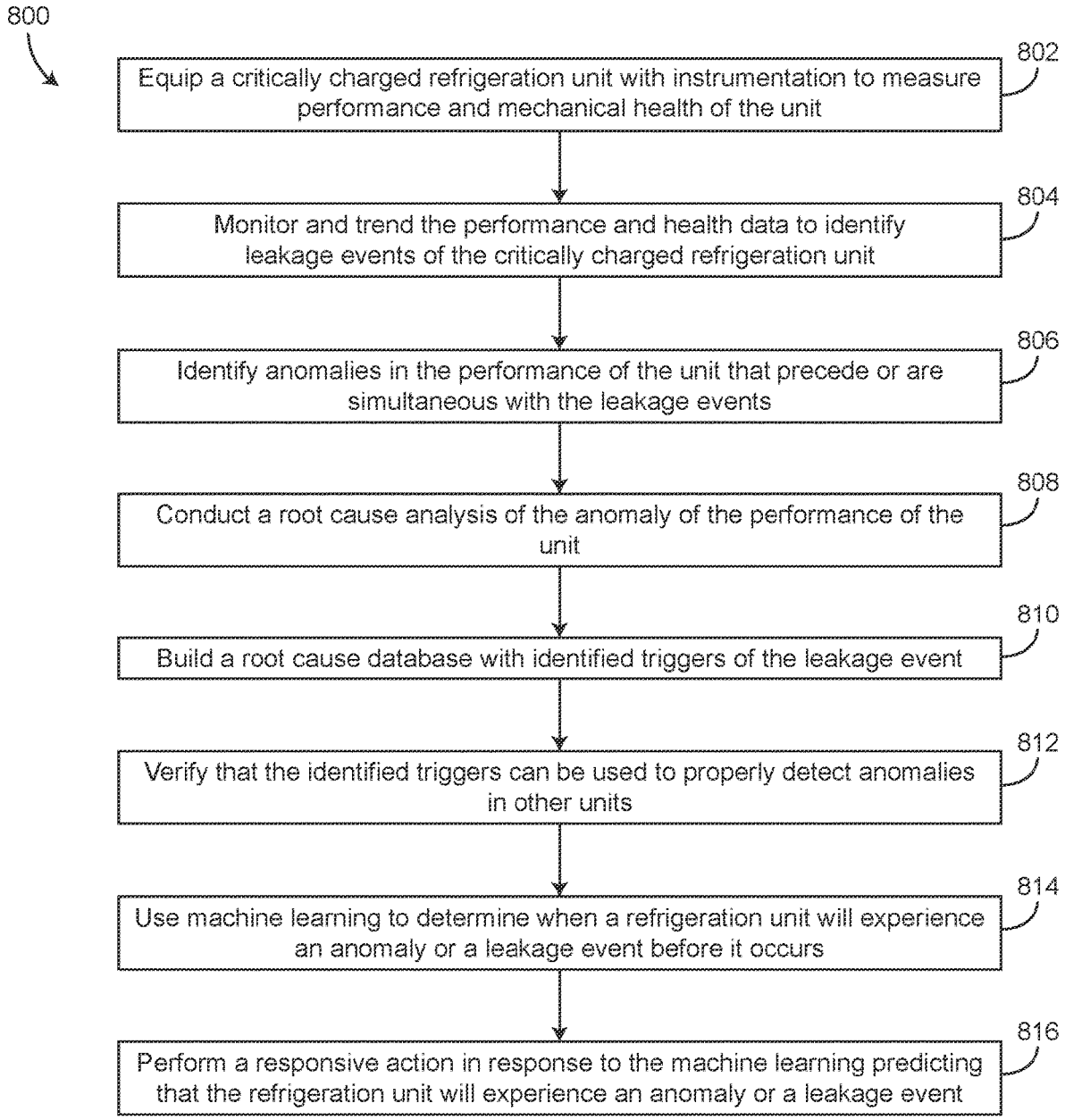
FIG. 8 is a flow diagram of a process for building a root cause analysis database and using machine learning for leakage prognostic of critically charged HVAC/Refrigeration systems, according to some embodiments.

Referring to FIG. 8, a flow diagram of a process 800 for developing a leakage prognostic is shown, according to some embodiments. The process 800 can be performed, at least partially, by the cloud computing system 104, or more generally, by the refrigerant tracking system 100. The process 800 includes steps 802-816 and may be performed to retrofit and develop an appropriate neural network, machine learning, or artificial intelligence technique to preemptively predict a leakage event at a critically charged HVAC/Refrigeration unit. In some embodiments, the process 800 includes two portions or stages: a diagnostic portion, and a prognostic portion. The diagnostic portion may include steps 802-804, while the prognostic portion includes steps 806-816.

Process 800 includes equipping a critically charged HVAC/Refrigeration unit with instrumentation to measure performance and mechanical health of the unit (step 802), according to some embodiments. In some embodiments, step 802 includes installing one or more sensors or measurement devices on the HVAC/Refrigeration unit. In some embodiments, step 802 includes installing one or more sensors (e.g., current transformers for power consumption measurement, thermistors for temperature measurement, transducers for pressure measurement, etc.) at a suction side of a compressor of the HVAC/Refrigeration unit (e.g., to obtain compressor suction pressure and compressor suction temperature) at a discharge side of the compressor of the HVAC/Refrigeration unit (e.g., to obtain compressor discharge pressure and compressor discharge temperature), at an outlet of a condenser (e.g., to obtain condenser outlet pressure and condenser outlet temperature), at an outside location (e.g., to measure outside air temperature, outside air humidity, and outside air enthalpy), at an air inlet (e.g., to measure return air temperature, return air humidity, or return air enthalpy), at the compressor (e.g., to measure power drawn by the compressor such as in amperage), at a fan of the condenser (e.g., to measure power drawn by the fan of the condenser), at a fan of the evaporator (e.g., to measure power drawn by the fan of the evaporator), etc. In some embodiments, step 802 is performed by a technician to the HVAC/Refrigeration system 200. In some embodiments, the performance of the system is any temperature or pressure data of the refrigerant, or enthalpy of the refrigerant either measured using a sensor or calculated based on the measured temperature or pressure. In some embodiments, the mechanical health or mechanical performance of the unit includes the power drawn by the compressor, the condenser fan, the evaporator fan, etc. In some embodiments, the performance of the unit is evaluated using subcooling temperature of the condenser (e.g., a temperature or enthalpy of the refrigerant at an outlet of the condenser 206), superheat temperature of the compressor (e.g., a temperature or enthalpy of the refrigerant at an outlet of the compressor 204), evaporator enthalpy (e.g., enthalpy of the refrigerant at an inlet or an outlet of the evaporator 202), etc., or some combination thereof.

Process 800 includes monitoring and trending the performance and health data to identify leakage events of the critically charged HVAC/Refrigeration unit (step 804), according to some embodiments. In some embodiments, step 804 is performed by the cloud computing system 104 or by the controller 102. In some embodiments, step 804 includes monitoring and comparing a current value, an average value, a trend, a rate of change, etc., of the subcooling temperature of the condenser to a threshold or a normal operating range. In some embodiments, step 804 includes identifying that a leakage event has occurred in response to the comparison. In some embodiments, step 804 includes performing the process 600 or portions of the process 600 (e.g., steps 608-610).

Process 800 includes identifying anomalies in the performance of the unit that precede the leakage events (step 806), according to some embodiments. In some embodiments, anomalies include any performance data (e.g., as obtained in step 802) being outside of a normal operating range, a trend of the performance data over time, a pattern of the performance data over time, etc. In some embodiments, step 806 is performed using a neural network, machine learning, or artificial intelligence. In some embodiments, step 806 is performed by a technician or a system administrator. In some embodiments, the anomalies are also detected in the health data of the unit (e.g., the power drawn by the compressor, etc.). In some embodiments, step 806 includes identifying anomalies in the performance of the unit if performance of a HVAC/Refrigeration system of the unit is degrading over time, but component health monitoring of individual components of the unit are unchanging.

Process 800 includes conducting a root cause analysis of the anomaly of the performance of the unit (step 808), according to some embodiments. In some embodiments, step 808 is performed by a technician by performing a physical inspection of the unit. The technician may perform an on-site inspection of the unit and determine the root cause (e.g., a broken component, a faulty sensor, etc.) of the anomaly (e.g., the leakage event). The technician can provide the root cause determined through inspection to the cloud computing system 104 as part of an inspection procedure (e.g., via the connectivity between the controller 102). In some embodiments, the root cause analysis is performed by the technician as part of a charging procedure or part of a checkup on the system 200. Step 808 can include conducting the root cause analysis for a population of HVAC/Refrigeration units. It should be understood that the term "anomaly" may refer to changes in the performance data (e.g., a performance anomaly) that indicates or is indicative of a leakage event. In this way, the systems and methods infer the presence of leak or leakage events based on anomalous performance data, and anomalous performance data and the root cause thereof can be predicted using machine learning to provide leak event (e.g., anomalous performance data) prognostics.

Process 800 includes building a root cause database with identified triggers of the leakage event (e.g., as indicated by the anomalous performance data) (step 810), according to some embodiments. In some embodiments, step 810 includes repeating step 808 for a population or fleet of HVAC/Refrigeration units (e.g., critically charged HVAC/Refrigeration units) over a time period (e.g., multiple lifetimes of the units) to build up the root cause database with the identified triggers (e.g., changes in the subcooling temperature or other performance data) so that a neural network can be trained based on the database. In some embodiments, step 810 is performed by the cloud computing system 104.

Process 800 includes verifying that the identified triggers can be used to properly detect anomalies in other units (step 812) and using machine learning to determine when a HVAC/Refrigeration unit will experience an anomaly before it occurs (step 814), according to some embodiments. In some embodiments, step 812 and/or step 814 includes training a neural network, machine learning, or artificial intelligence, based on the root cause database, to predict leakage events as a function of performance and mechanical health of the unit before the leakage event occurs. Specifically, the neural network, machine learning, or artificial intelligence uses anomalies of the subcooling temperature or a subcooling value (e.g., temperature, pressure, enthalpy, etc., at an outlet of the condenser 206, an inlet of the expansion valve 208, or a position between the outlet of the condenser 206 and the inlet of the expansion valve 208) to predict leakage events before they occur or as they initially begin to occur but before the leakage event becomes significant. The machine learning can also be configured, once properly trained, to identify a root cause of the anomaly or the leakage event. In some embodiments, steps 812-814 are performed by the cloud computing system 104. In some embodiments, step 812 includes using the neural network or machine learning for another critically charged HVAC/Refrigeration unit that has a known root cause failure and leakage event, and checking if the output of the machine learning accurately matches the known root cause failure and leakage event.

In some embodiments, step 814 includes applying the machine learning that is trained based on the root cause database to identify, based on subcooling data of a new HVAC/Refrigeration unit, whether the new HVAC/Refrigeration unit will experience an anomaly and a leakage event in the near future, as well as a root cause of the anomaly or leakage event. In some embodiments, step 814 is performed after the machine learning has been trained and is ready for use. In some embodiments, step 814 is performed using real-time or currently obtained measured performance and/or mechanical health of the unit (e.g., from the instrumentation as installed in step 802). In some embodiments, step 814 is performed by the cloud computing system 104 based on real-time or currently obtained performance data and/or equipment data provided by the controller 102 or the HVAC/Refrigeration system 200 or of a different HVAC/Refrigeration system (e.g., a critically charged HVAC/Refrigeration system). The cloud computing system 104 may include processing circuitry including memory and a processor, similar to the processing circuitry 802 of the controller 102, the processor 804, and the memory 806, in a single location or in a distributed manner. In some embodiments, steps 814-816 include performing the process 1600 as described in greater detail above with reference to FIG. 7.

Process 800 includes performing a responsive action in response to the machine learning predicting that the HVAC/Refrigeration unit will experience an anomaly or a leakage event (step 816), according to some embodiments. In some embodiments, step 816 includes operating a user device or screen thereof to notify a user, a building manager, a system administrator, a technician, etc., regarding the predicted anomaly or leakage event, as well as the expected root cause. In some embodiments, step 816 is performed by the cloud computing system 104 and one or more user device. In some embodiments, step 816 includes prompting or scheduling maintenance at the HVAC/Refrigeration unit prior to the leakage event so that the leakage event can be prevented.

Figure 9:
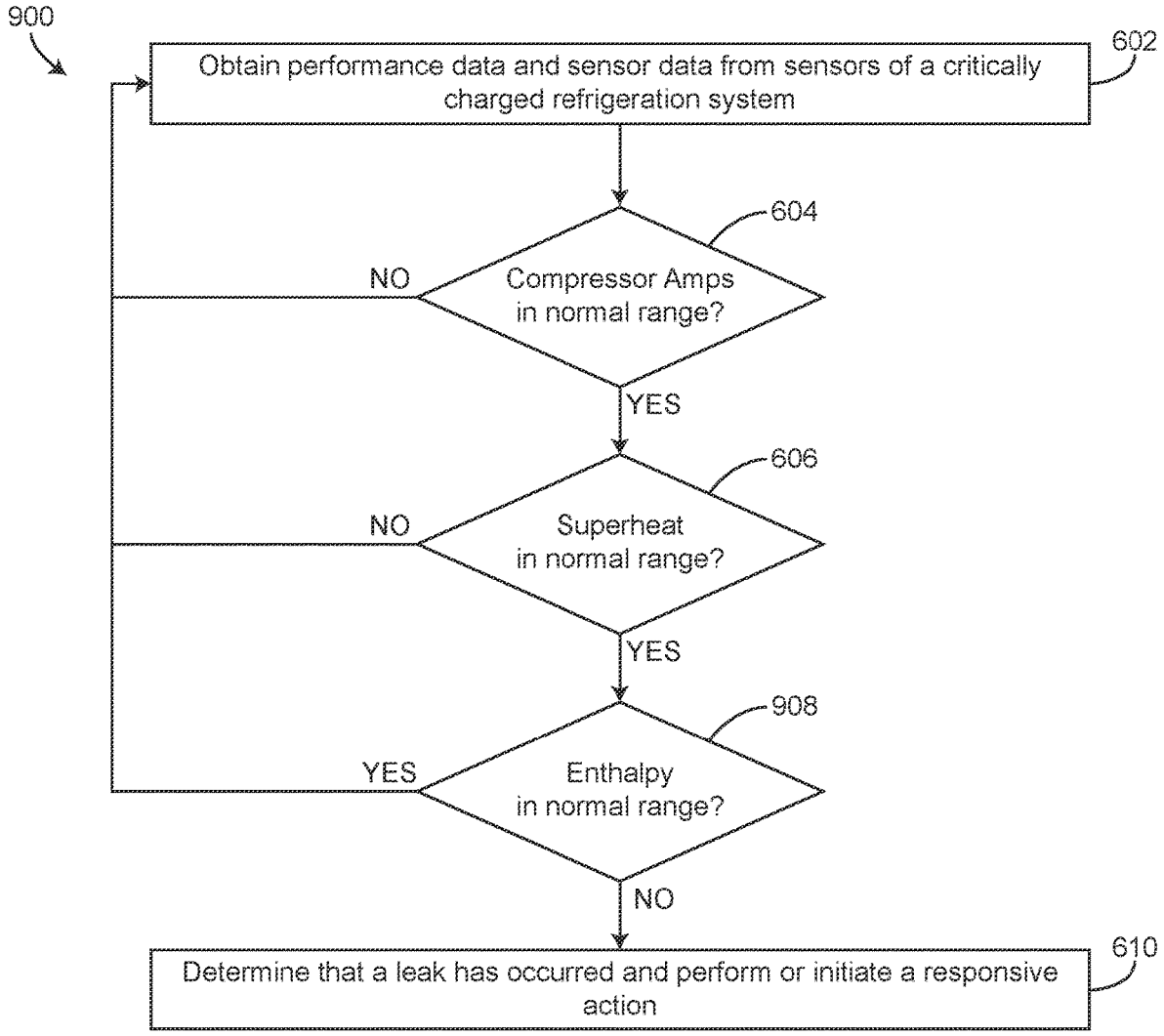
FIG. 9 is a flow diagram of a process for determining if a leakage event has occurred based on enthalpy, according to some embodiments.

Referring to FIG. 9, a flow diagram of a process 900 for detecting leakage (e.g., leakage diagnostic) using enthalpy data is shown, according to some embodiments. Process 900 includes steps 602-606, step 908, and step 610. In some embodiments, process 900 is performed by the controller 102 or the cloud computing system 104 to determine, based on the enthalpy data, if the HVAC/Refrigeration system 200 is leaking. The steps 602-606 may be performed the same as described in greater detail above with reference to FIG. 5.

Process 900 also includes determining if enthalpy is within a normal range (step 908), according to some embodiments. In some embodiments, the enthalpy data is enthalpy of the refrigerant of the HVAC/Refrigeration system 200. The enthalpy data can be obtained from the same location as the subcooling data (e.g., at an outlet of the condenser 206) or may be obtained at a different location along the piping 210. For example, the enthalpy data may be obtained at the outlet of the expansion valve 208, at an inlet of the evaporator 202, at an outlet of the evaporator 202, at an inlet of the compressor 204, at an outlet of the compressor 204, or at an inlet of the condenser 206. In some embodiments, the enthalpy is a change in enthalpy of the refrigerant of the HVAC/Refrigeration system 200, or a difference between two locations along the HVAC/Refrigeration system 200. In some embodiments, the enthalpy is a delta value at an air return temperature of the HVAC/Refrigeration system 200. In response to the enthalpy being in the normal range, process 900 returns to step 602. In response to the enthalpy being outside of the normal range, process 900 proceeds to step 610.

Figure 10:
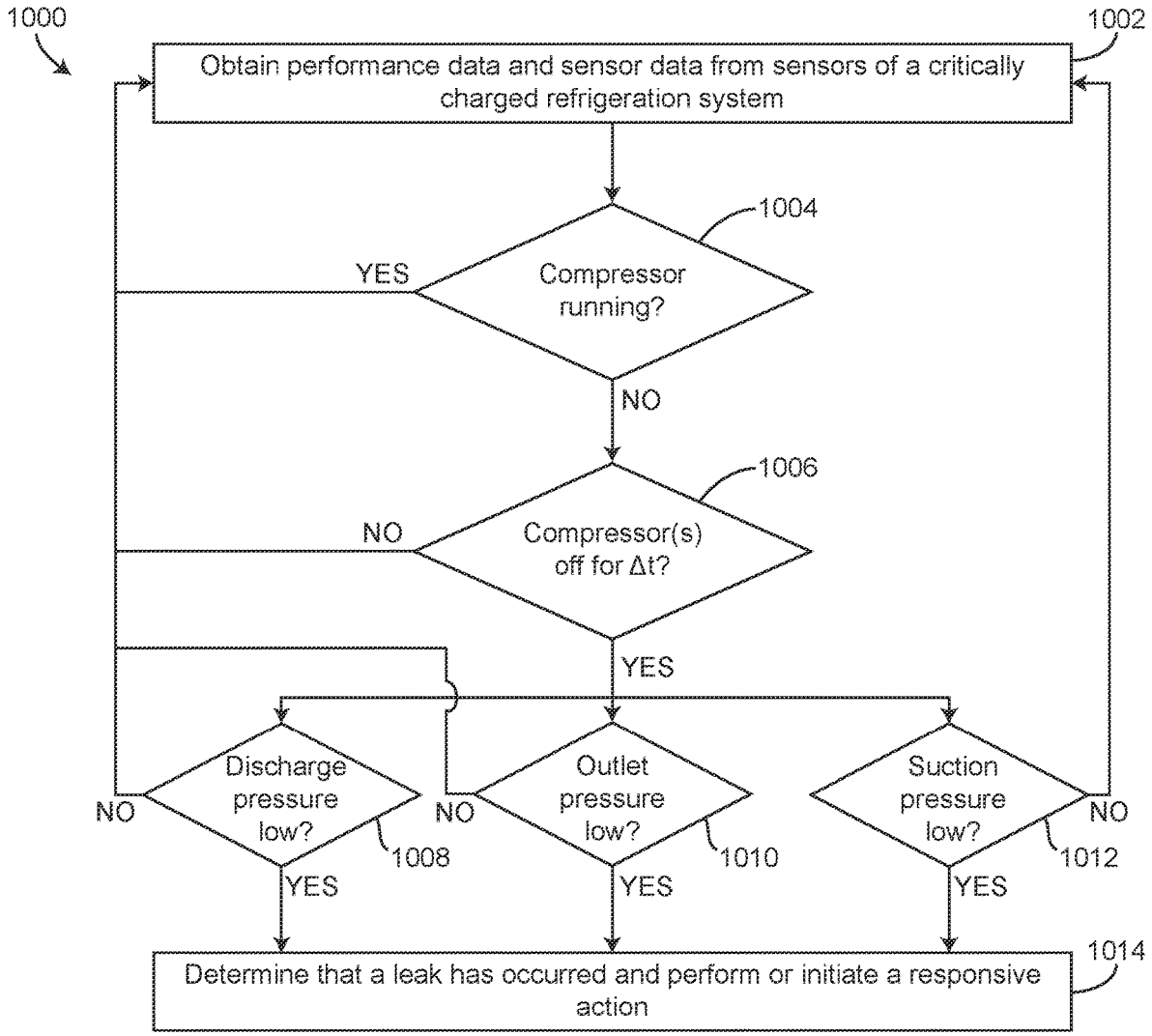
FIG. 10 is a flow diagram of a process for determining if a leakage event has occurred based on refrigerant pressure, according to some embodiments.

Referring to FIG. 10, a flow diagram of a process 1000 for detecting leakage (e.g., leakage diagnostics) using pressure data is shown, according to some embodiments. Process 1000 includes steps 1002-1014 and can be performed by the controller 102 or the cloud computing system 104. In some embodiments, process 1000 is performed in order to achieve a diagnosis of a leakage event.

Process 1000 includes obtaining performance data and sensor data from sensors of a critically charged HVAC/Refrigeration system (step 1002), according to some embodiments. In some embodiments, step 1002 is the same as or similar to step 602 of process 600. Process 1000 also includes determining if a compressor of the HVAC/Refrigeration system 200 is currently running (step 1004), according to some embodiments. In some embodiments, step 1004 is performed by monitoring or identifying Amperage of the compressor. If the compressor is running, process 1000 returns to step 1002. If the compressor is not running, process 1000 proceeds to step 1006.

Process 1000 includes determining if the compressor (e.g., the compressor 204) has been off for an amount of time Δt (step 1006), according to some embodiments. In some embodiments, if the compressor has not been off for the amount of time Δt (e.g., half an hour), process 1000 returns to step 1002 or step 1004. Once the compressor has been shut off for at least the amount of time Δt (step 1006, "YES"), process 1000 proceeds to steps 1008, 1010, and 1012.

Process 1000 includes determining if discharge pressure is low (step 1008), determining if outlet pressure is low (step 1010), and/or determining if suction pressure is low (step 1012), according to some embodiments. In some embodiments, step 1008 includes determining if discharge pressure is now lower than previously recorded for a current ambient temperature. In some embodiments, the discharge pressure is pressure of the refrigerant at a discharge or outlet of the compressor 204. In some embodiments, step 1010 includes determining if outlet pressure is now lower than previously recorded for a current ambient temperature. In some embodiments, step 1012 includes determining if suction pressure is now lower than previously recorded for a current ambient temperature. In some embodiments, the suction pressure is a pressure of the refrigerant at a suction or inlet side of the compressor 204. In response to any of the discharge pressure, the outlet pressure, or the suction pressure being low, process 1000 proceeds to step 1014 and determines that a leak has occurred. Step 1014 can be the same as or similar to the step 610 as described in greater detail above.

It should be understood that while enthalpy and pressure are described herein with reference to FIGS. 9-10 as being used for diagnosis, the enthalpy and pressure can also be used for prognosis in combination with the subcooling data.

Configuration of Exemplary Embodiments

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claim.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

What is claimed is:

1. A system for predicting a leak of a HVAC/Refrigeration system, the system comprising:

a cloud computing system; and a first HVAC/Refrigeration system comprising a controller configured to at least one of communicate directly with the cloud computing system, or communicate with the cloud computing system through a user device in communication with the controller of the first HVAC/Refrigeration system; and wherein the cloud computing system comprises processing circuitry configured to communicate with the first HVAC/Refrigeration system and a plurality of other HVAC/Refrigeration systems to:

obtain performance data and health data from the plurality of other HVAC/Refrigeration systems, wherein the performance data comprises subcooling data of the plurality of other HVAC/Refrigeration systems and at least one of superheat data or enthalpy data of the plurality of other HVAC/Refrigeration systems;

train a neural network to predict a leakage event based on the performance data and the health data, wherein the cloud computing system is configured to provide leak data to the neural network to train the neural network based on the leak data, and wherein the leak data is determined based at least in part on a comparison between a subcooling temperature of refrigerant of the other HVAC/Refrigeration systems and a threshold subcooling temperature;

obtain performance data and health data from the first HVAC/Refrigeration system;

use the neural network to predict a leak event at the first HVAC/Refrigeration system, wherein the neural network is configured to receive subcooling temperature data of the first HVAC/Refrigeration system as an input and predict the leak event of the first HVAC/Refrigeration system before or at a beginning of the leak event; and operate a display to provide a notification to a technician or a manager regarding the predicted leak event at the first HVAC/Refrigeration system, wherein the first HVAC/Refrigeration system and the plurality of other HVAC/Refrigeration systems are critically charged HVAC/Refrigeration systems.

2. The system of claim 1, wherein the health data comprises an amount of power drawn by the plurality of other HVAC/Refrigeration systems.

3. The system of claim 1, wherein the display is a display screen of a smartphone of the technician, wherein the notification prompts the technician to perform servicing at the first HVAC/Refrigeration system.

4. The system of claim 1, wherein the neural network is trained to predict the leak event and to predict a severity of the leak event.

5. The system of claim 1, wherein the subcooling temperature is a temperature of the refrigerant of the plurality of other HVAC/Refrigeration systems at one or more of:

an outlet of a condenser of the plurality of other HVAC/Refrigeration systems;

an inlet of an expansion valve of the plurality of other HVAC/Refrigeration systems; or a position along a tubular member extending between the outlet of the condenser and the inlet of the expansion valve.

6. The system of claim 1, wherein the leak data is obtained based at least in part on a first quantity of refrigerant added to a HVAC/Refrigeration system or a second quantity of refrigerant removed from the HVAC/Refrigeration system, the data comprising at least one of a measurement of the first quantity or a measurement of the second quantity.

7. The system of claim 6, wherein the leak data comprises a difference between (i) the measurement of the first quantity at a first time at which a first service operation is performed, and (ii) the measurement of the second quantity at a second time at which a second service operation is performed, wherein the second time occurs after the first time.

* * * * *